US006087602A

United States Patent [19]

Bernier et al.

[11] Patent Number: 6,087,602

[45] Date of Patent: Jul. 11, 2000

[54] MOTOR CONTROL CENTER CIRCUIT BREAKER ASSEMBLY

[75] Inventors: Richard Emery Bernier; Gilbert Anthony Soares, both of Melbane; Edgar Yee, Chapel Hill, all of N.C.

[73] Assignee: General Electric Company, Schenectady, N.Y.

[21] Appl. No.: 09/347,089

[22] Filed: Jul. 2, 1999

[51] Int. Cl.[7] ..... H01H 9/20

[52] U.S. Cl. ..... 200/50.11; 200/50.02; 200/50.19

[58] Field of Search ..... 200/43.11, 43.14, 200/43.15, 50.01, 50.02, 50.03, 50.11, 50.12, 50.17, 50.19, 50.21–50.26, 400, 401; 361/605–610, 615, 616, 622, 623, 621, 631, 634, 673

[56] References Cited

U.S. PATENT DOCUMENTS

| | | | |
|---|---|---|---|
| 3,213,224 | 10/1965 | Mrenna et al. | 200/50 |
| 4,034,169 | 7/1977 | Armstrong et al. | 200/50 A |
| 4,260,975 | 4/1981 | Wilcox et al. | 336/65 |
| 4,760,220 | 7/1988 | Fritsch et al. | 200/50 A |
| 4,785,145 | 11/1988 | Owens et al. | 200/162 |
| 4,789,919 | 12/1988 | Cox et al. | 361/339 |
| 4,884,164 | 11/1989 | Dziura et al. | 361/97 |
| 4,945,450 | 7/1990 | Sabatella et al. | 361/334 |
| 5,424,911 | 6/1995 | Joyner et al. | 361/616 |
| 5,642,256 | 6/1997 | Pugh et al. | 361/615 |
| 5,657,193 | 8/1997 | Purkayastha | 361/23 |
| 5,663,862 | 9/1997 | Hopping-Mills | 361/115 |

*Primary Examiner*—Michael Friedhofer
*Attorney, Agent, or Firm*—Cantor Colburn LLP

[57] ABSTRACT

A circuit breaker is configured as an electric disconnect switch within a motor control center enclosure and is arranged on a functional support platform. An extended operating handle operator on the platform interacts with the circuit breaker ON/OFF handle to indicate the circuit breaker TRIPPED condition.

9 Claims, 5 Drawing Sheets

MOTOR CONTROL CENTER CIRCUIT BREAKER ASSEMBLY

BACKGROUND OF THE INVENTION

This invention relates to circuit breakers, and, more particularly, to a motor control center circuit breaker assembly.

Motor control centers, such as described in U.S. Pat. No. 5,424,911 entitled Compact Motor Controller Assembly, contain several components related to electric motor operation such as electric contactors, circuit breakers, power supply transformers, disconnect switches and the like.

An electric disconnect switch is described in U.S. Pat. No. 4,785,145 entitled Modular Electrical Disconnect Switch, and one such circuit breaker is described in U.S. Pat. No. 4,884,164 entitled Molded Case Circuit Interrupter. The use of a circuit breaker for both motor protection and switch functions is described in U.S. Pat. No. 4,945,450 entitled Modular Electric Switch-Circuit Breaker Assembly. A unit combining both circuit breaker and contactor functions is found in U.S. Pat. No. 5,657,193 entitled Electronic Control Module for Motor Controller Units.

When several electric devices are combined within a common enclosure, it is important that the enclosure interior remain inaccessible when the electrical devices are operating to prevent damage to both equipment and personnel. The aforementioned U.S. Pat. No. 5,424,911 employs an external interlock device to insure that the circuit breaker operating handle is in the OFF position prior to providing access to the interior of the motor controller unit. When a circuit breaker is used within non-interlocked motor controller units, it is important to view the ON/OFF positions of the circuit breaker operating handle, prior to accessing the motor controller interior.

SUMMARY OF THE INVENTION

In an exemplary embodiment of the invention, a circuit breaker is configured as an electric disconnect switch within a motor control center enclosure and is arranged on a functional support platform. An extended operating handle operator on the platform interacts with a circuit breaker ON/OFF handle to indicate the circuit breaker TRIPPED condition. A lock-out lever pivotally-mounted on the platform further interacts with the circuit breaker handle and the enclosure cover to prevent removal of the circuit breaker from the enclosure when the circuit breaker handle is in the ON position. The electric disconnect assembly of this exemplary embodiment multi-functionally provides enhanced visual indication of the ON/OFF position of the circuit breaker operating handle while insuring that the circuit breaker cannot be removed from the assembly enclosure until and unless the circuit breaker operating handle is in the OFF position. Visual indication of the TRIPPED condition of the circuit breaker operating handle is also provided.

DESCRIPTION OF THE PREFERRED EMBODIMENT

Figure 1:
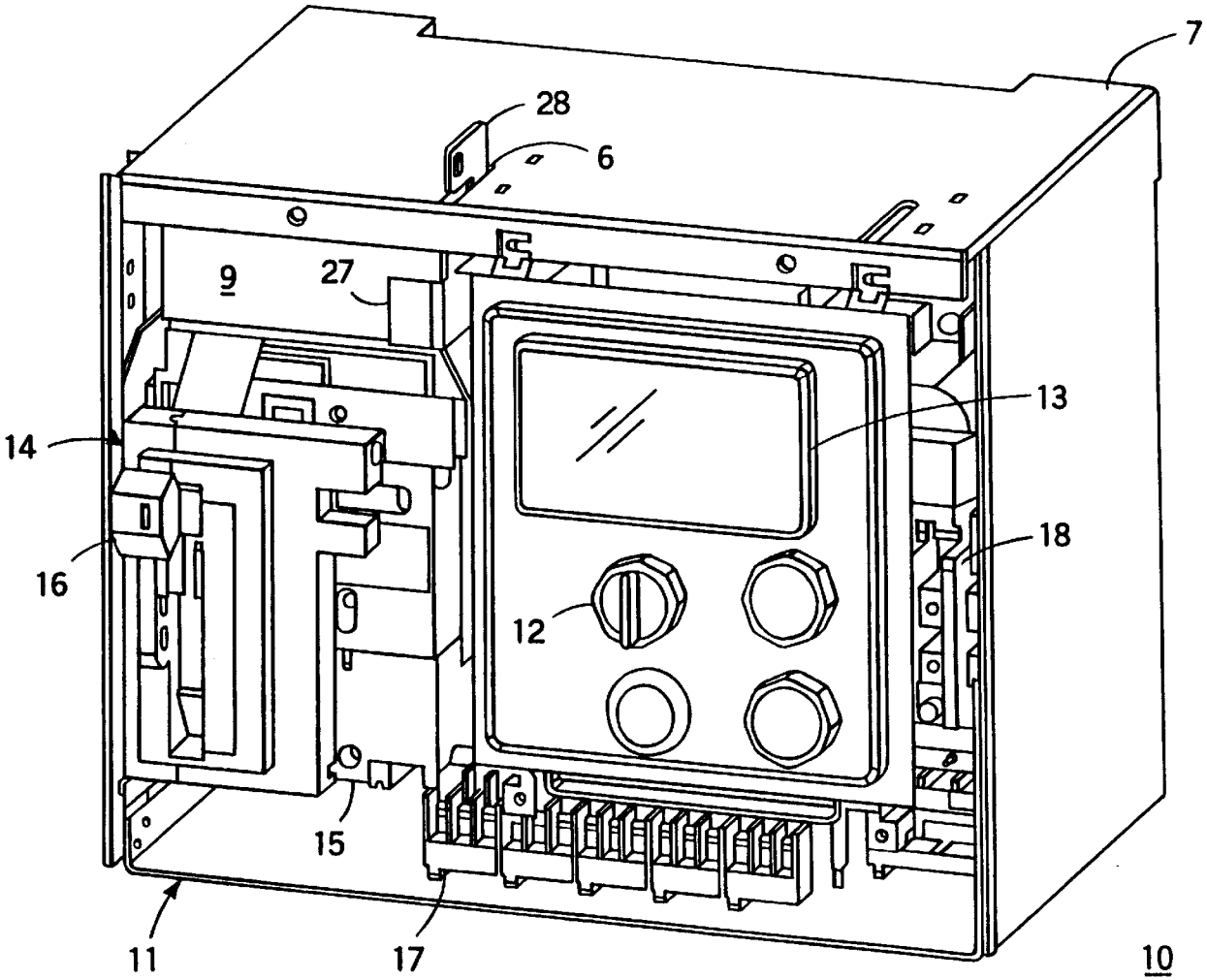
FIG. 1 is a front perspective view of a motor control center containing the circuit breaker configuration in accordance with the invention.

Referring to FIG. 1, a motor control center 10 similar to that described in the aforementioned U.S. Pat. No. 5,424,911, which is incorporated by reference, is generally shown. An enclosure 11 includes control knobs 12 and an indicator window 13 for providing access to electrical components, such as a motor contactor unit 18 similar to that described within the aforementioned U.S. Pat. No. 5,657,193, which is incorporated by reference. Electrical connection between the electrical components and an associated electrical distribution system is made by terminal connectors 17 located on the front of the enclosure. A circuit breaker assembly 14, in this exemplary embodiment of the invention, includes a handle operator assembly 16 extending from the front of enclosure 11 for providing manual operation of a circuit breaker 15 and is attached to a rear wall 9 of enclosure 11 in the manner to be described below. The circuit breaker assembly is prevented from removal from the enclosure by virtue of a front tab 27 that operatively connects with a top tab 28 extending through an access slot 6 formed in a cover 7 of enclosure 11 when the handle operator assembly 16 is in the ON position in the manner best seen by now referring to FIG. 2.

Figure 2:
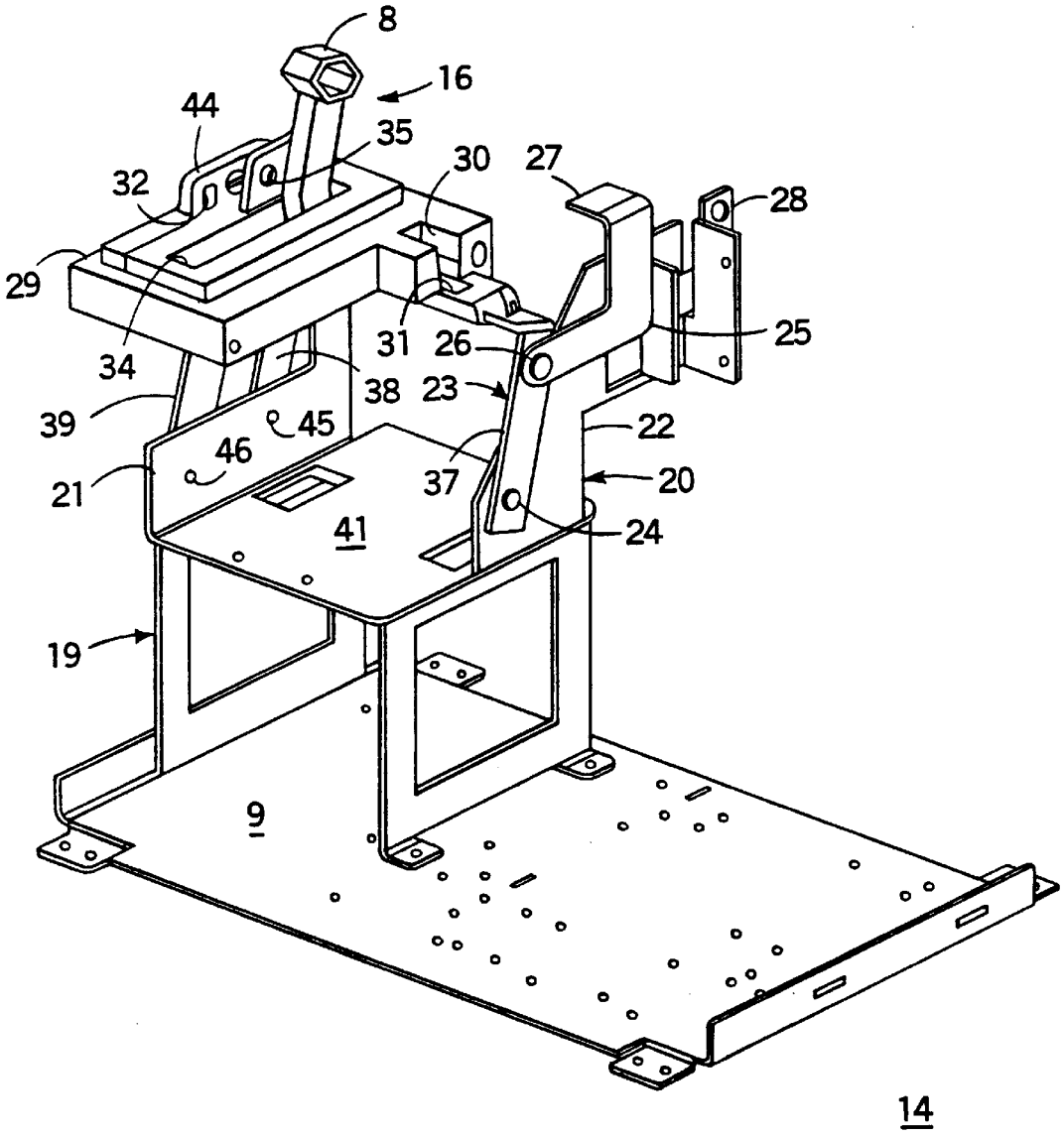
FIG. 2 is an enlarged top perspective view of the circuit breaker functional support platform within the motor control center of FIG. 1.

The circuit breaker assembly 14 shown in FIG. 2 attaches to wall 9 through an accessory enclosure support 19. One such accessory is a power transformer of the type described within U.S. Pat. No. 4,260,975 entitled Transformer with Terminal Board Support and Clamping-Mounting Structure, which is incorporated by reference. The circuit breaker 15 (FIG. 1) is mounted on a handle support assembly 20 defined by a pair of opposing side arms 21, 22 with a bottom connecting bight 41. A U-shaped actuator 23 extends across the top of the handle support assembly 20 to provide a circuit breaker handle access slot 31, subjacent a face plate slot 30 arranged in an operating handle face plate 29. The operating handle assembly 16 includes operating handle face plate 29 with an elongate slot 34 for transfer of a handle operator 8. A circuit breaker operating handle 36 (FIG. 3) extends through corresponding access slots 30, 31 and the circuit breaker 15 is positioned on the bottom connecting bight 41. A handle operator extender 39 is pivotally attached to the sidearm 21 by a pivot 46 and is pivotally attached by a trip indicator level 40 to an angled side arm 38, which in turn is pivotally attached to the sidearm 21 by a pivot 45. The operation of the trip indicator level 40 will be discussed below with reference to FIG. 5. An aperture 44 on a locking hasp 32 extends from the plate 29 and cooperates with an aperture 35 on the handle operator 8 to lock the handle operator in the OFF position. The U-shaped actuator 23 is pivotally attached to the sidearm 22 by a pivot 24 and a T-shaped lockout lever 25 is pivotally attached to the U-shaped actuator 23 by a pivot 26. The front tab 27 extends from the center of the T-shaped lockout lever 25 and a top tab 28 extends from the end thereof.

Figure 3:
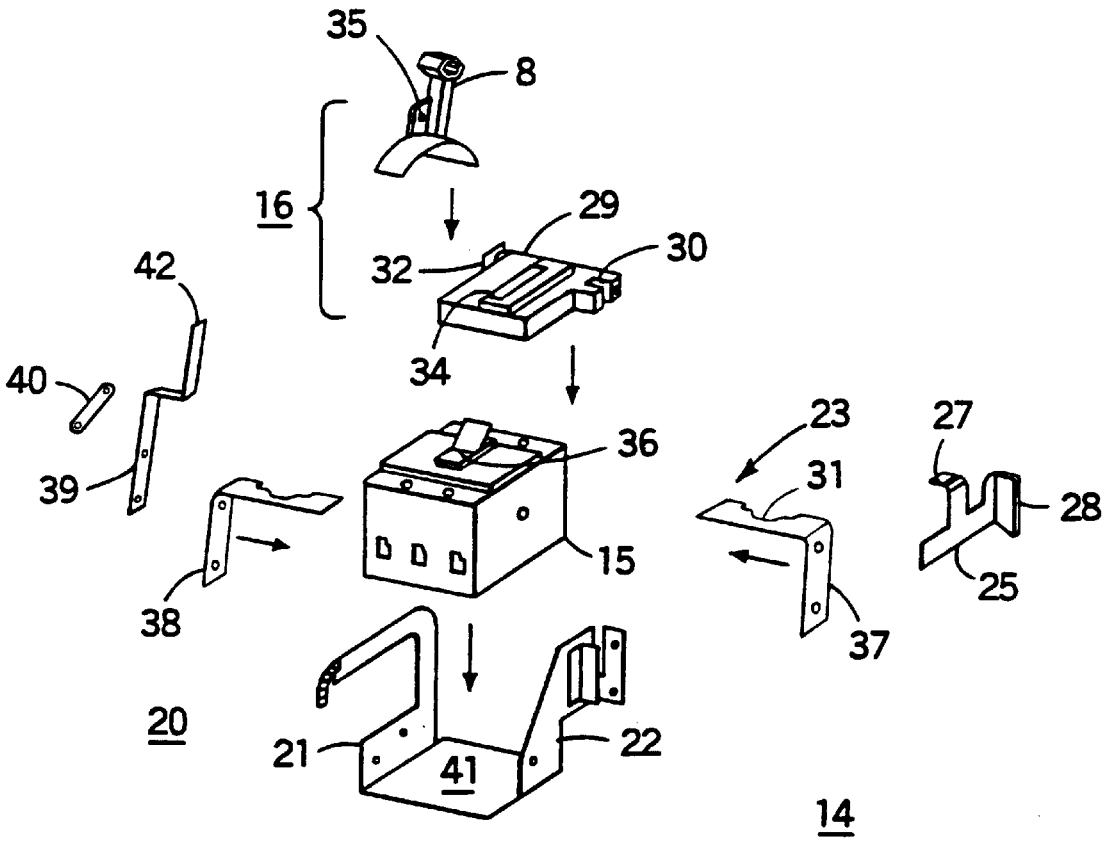
FIG. 3 is a top perspective view of the components of the functional support platform of FIG. 2 in isometric projection prior to assembly.

The components within the circuit breaker assembly 14 are now shown prior to assembly relative to the circuit breaker 15 in FIG. 3. The circuit breaker is positioned on the bottom bight 41 intermediate the sidearms 21, 22 of the handle support assembly 20. The U-shaped actuator 23 comprises two angled side arms 37, 38 which are positioned on opposite sides of the circuit breaker and extend alongside the circuit breaker operating handle 36 for picking up the logic of the position of the circuit breaker handle as it moves between the ON, OFF and TRIPPED positions. The face plate 29 including the locking hasp 32 and slots 34, 30 within the handle operating assembly 16, described earlier, is positioned over the circuit breaker and the circuit breaker operating handle 36 is located within the slot 30. The handle operator 8 is positioned within the slot 34 so that the aperture 35 on the handle operator aligns with the locking hasp 32 on the face plate 29. The T-shaped lockout lever 25 having front and top tabs 27, 28 is attached to the side arm 37 and sidearm 22 for allowing pivotal rotation of the lockout lever relative to the circuit breaker operating handle 36 upon rotation of the sidearm 37 in the manner to be described below with reference to FIG. 4. The trip indicator lever 40 pivotally attaches to the handle operator extender 39 and to the side arm 38 for picking up the logic of the position of the circuit breaker handle as it moves between the ON, OFF and TRIPPED positions and for indicating the circuit breaker operating handle TRIPPED position via a target 42 extending from one end of the handle operator extender 39 in the manner to be described below with reference to FIG. 5.

Figure 4:
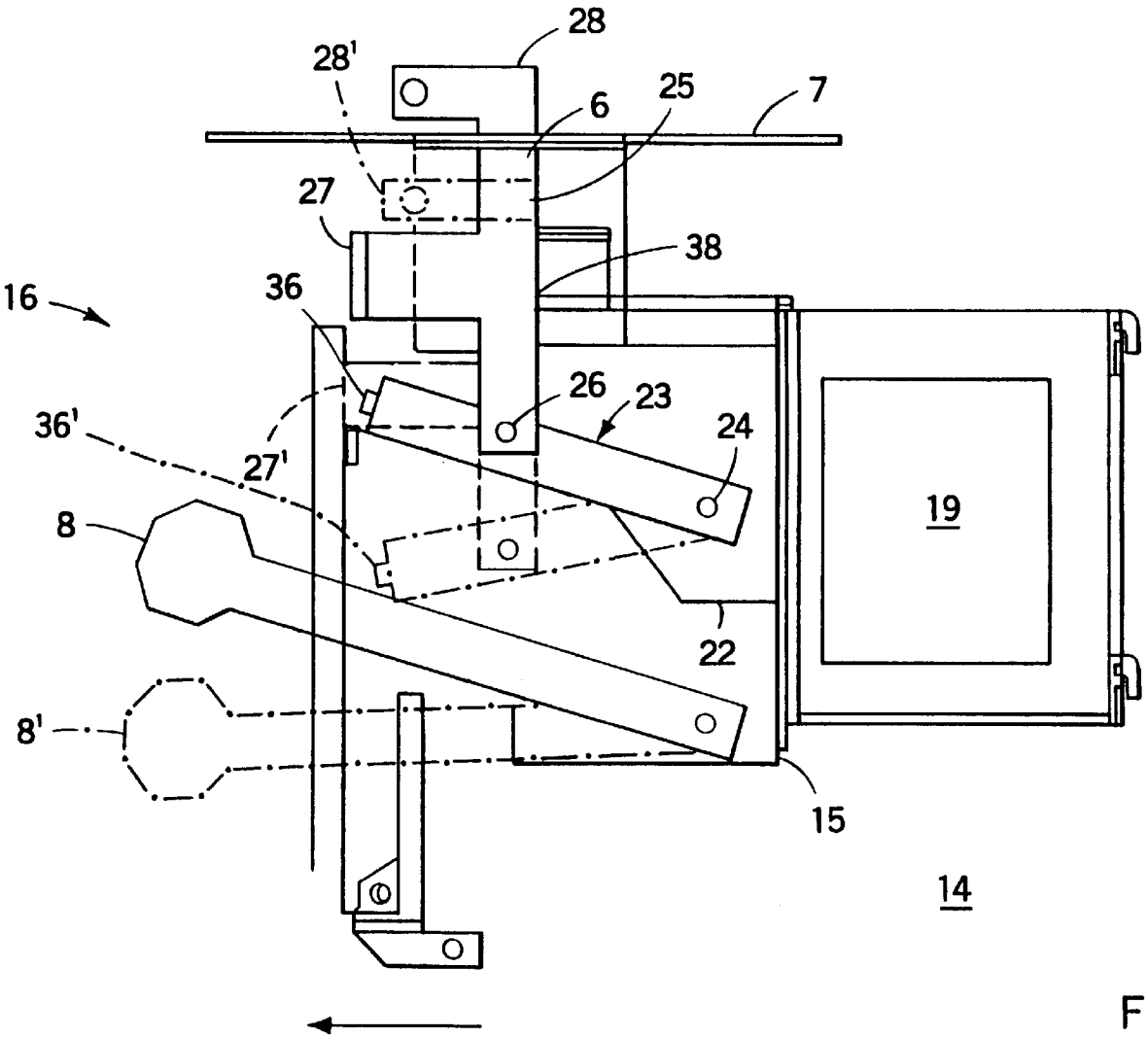
FIG. 4 is side view of the functional support platform FIG. 2 depicting the circuit breaker-enclosure interlock function.

The circuit breaker assembly 14 is shown in FIG. 4, as viewed to the right of the assembly of FIG. 2, with the circuit breaker 15 mounted on the accesory enclosure support 19 and with the top tab 28 on the lockout lever 25 extending through slot 6 in cover 7. The handle operating assembly 16 prevents removal of the circuit breaker 15 from the enclosure when the circuit breaker operating handle 36 and handle operator 8 are in the ON position, shown in solid lines in FIG. 4, by keeping the lockout lever 25 and front tab 27 in the extended position. Moving the handle operator 8 and circuit breaker operating handle 36 to the OFF position, as indicated at 36' and 8' in phantom, rotates the U-shaped actuator 23 about the pivot 24 on the sidearm 22 in the counterclockwise position to translate the attached lockout lever 25 and front tab 27 and top tab 28 in the downward position as indicated at 27', 28' in phantom. The displacement of the top tab 28 from the compartment cover 7 then allows the circuit breaker 15 and the handle operating assembly 16 to be moved in the direction indicated by the arrow in FIG. 4 for repair and replacement purposes.

Figure 5:
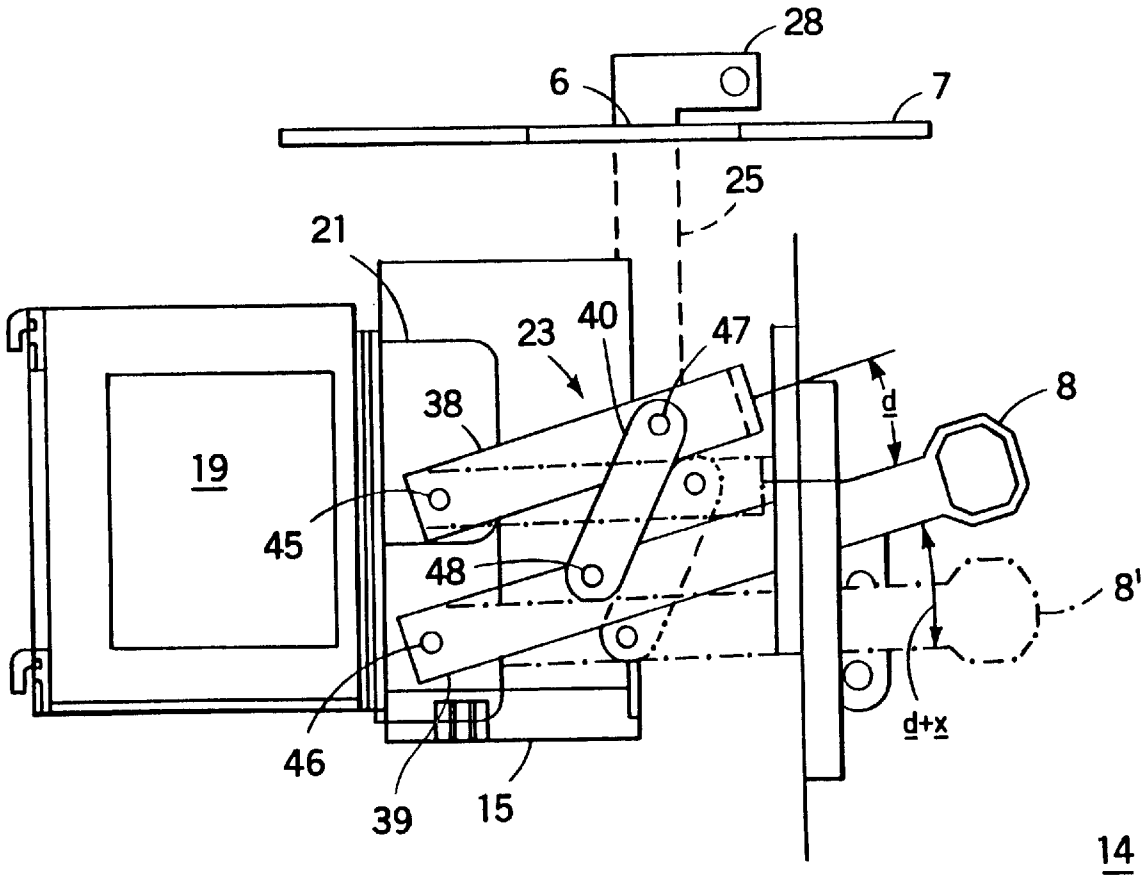
FIG. 5 is an opposing side view of the functional support platform of FIG. 4 depicting the circuit breaker handle indicator function.

The circuit breaker assembly 14 is shown in FIG. 5, as viewed to the left of the assembly of FIG. 2, with the circuit breaker 15 mounted on the accesory enclosure support 19 and with the top tab 28 on the lockout lever 25 extending through the slot 6 in cover 7. The U-shaped actuator 23 is arranged about the top of the circuit breaker 15, in the manner described earlier, whereby the rotation of the right angle side arm 38, pivotally attached to the sidearm 21 by pivot 45, follows the movement of the circuit breaker handle 36 (FIG. 3, although it is not visible in FIG. 5). The handle operator extender 39 pivotally connects with the side arm 38 by the trip indicator lever 40 and a pivot 48 and the trip indicator lever 40 pivotally connects with the side arm 38 by a pivot 47. The purpose of the trip indicator lever 40 is to extend the separation distance "d" between the handle operator extender 39 and the side arm 38 when the handle operator is in the ON position, depicted in solid lines, to the separation distance "d"+"x" depicted in phantom as the circuit breaker handle (not shown) and the handle operator 8 moves to the position depicted in phantom at 8'. The extended displacement of the handle operator 8 is an important feature of the invention for providing clear visual indication of the occurrence of a circuit breaker trip operation.

A motor operator assembly has herein been described whereby the circuit breaker is prevented from removal from a motor controller compartment when the circuit breaker is in the ON condition. The extended movement of the handle operator on the front of the compartment gives a clear visual indication that the circuit breaker has experienced a TRIP occurrence. Also, the above-described assembly provides a modular disconnect assembly thereby eliminating the need to stock multiple assembly sizes resulting in a substantial cost savings, this modularity is an important feature of the present invention.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A motor control center comprising:

an enclosure comprising a cover, bottom, rear and opposing sidewalls; and a circuit breaker assembly oriented within the enclosure comprising;

a circuit breaker having a circuit breaker operating handle, a handle support assembly comprising a bottom bight oriented intermediate a pair of upstanding first and second support side arms wherein the circuit breaker is positioned on the bottom bight intermediate the first and second support side arms, a U-shaped actuator comprising first and second angled side arms, the first angled side arm comprises a first horizontal top arm and a first vertical side arm and the second angled side arm comprises a second horizontal top arm and a second vertical side arm, the first vertical side arm is pivotally attached at a first end to the first support side arm and the second vertical side arm is pivotally attached at a first end to the second support side arm, the first horizontal top arm and the second horizontal top arm overlap to form a connecting top arm having a circuit breaker handle access slot formed therein, and wherein the circuit breaker operating handle extends through the circuit breaker handle access slot, and a lock out lever pivotally attached at a first end to a second end of the first vertical side arm, wherein the lock out lever comprises a top tab that extends through a slot in the cover for preventing the removal of the circuit breaker when the circuit breaker operating handle is in an ON position.

2. The motor control center of claim 1 wherein the circuit breaker assembly further comprises;

a handle operator assembly comprising;

a handle operator with a handle operator extender; and an operating handle faceplate comprising an elongated slot formed therein for passing the handle operator with the handle operator extender; wherein the handle operator extender is pivotally attached at a first end to the second support side arm.

3. The motor control center of claim 2 wherein the circuit breaker assembly further comprises;

a trip level indicator pivotally attached at one end to the second vertical side arm and pivotally attached at an opposite end to the handle operator extender used for extending the movement of the handle operator extender when the circuit breaker operating handle moves from the ON position to a TRIPPED position.

4. The motor control center of claim 3 wherein the operating handle faceplate further comprises;

a faceplate slot for receiving the circuit breaker operating handle so that as the operating handle with the handle operator extender is rotated the U-shaped actuator also rotates so that the circuit breaker handle access slot drives the circuit breaker operating handle along with the operating handle faceplate between the ON, TRIPPED and an OFF position.

5. The motor control center of claim 2 wherein the handle operator further comprises;

an aperture and the operating handle faceplate further comprises a locking hasp having a hasp aperture so that when the aperture on the handle operator and the hasp aperture on the locking hasp align the handle operator can be locked in an OFF position.

6. The motor control center of claim 1 wherein the circuit breaker assembly is mounted on an accessory enclosure support.

7. The motor control center of claim 6 wherein the circuit breaker assembly further comprises an electric transformer.

8. The motor control center of claim 1 wherein the lockout lever further comprises;

a front tab located beneath the top tab and oriented perpendicular to the top tab wherein the front tab provides visual indication of whether the top tab is in a lock out position.

9. The motor control center of claim 1 wherein the top tab extends from above the cover to beneath the cover when the circuit breaker operating handle moves from the ON position to the TRIPPED position.

* * * * *